US012392060B2

(12) United States Patent
O'Haire et al.

(10) Patent No.: US 12,392,060 B2
(45) Date of Patent: Aug. 19, 2025

(54) AUXETIC ARTICLE

(71) Applicant: adidas AG, Herzogenaurach (DE)

(72) Inventors: Tom O'Haire, Nuremberg (DE); Martha Rachel Glazzard, Nottingham (GB)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 17/364,524

(22) Filed: Jun. 30, 2021

(65) Prior Publication Data

US 2022/0002917 A1 Jan. 6, 2022

(30) Foreign Application Priority Data

Jul. 1, 2020 (DE) ..... 10 2020 208 218.9

(51) Int. Cl.

| | |
|---|---|
| ***D03D 17/00*** | (2006.01) |
| ***D02G 3/32*** | (2006.01) |
| ***D03D 13/00*** | (2006.01) |
| ***D04B 1/14*** | (2006.01) |
| ***D04B 1/18*** | (2006.01) |
| ***D04B 1/22*** | (2006.01) |
| ***D04B 21/18*** | (2006.01) |

(52) U.S. Cl.

CPC ..... *D03D 17/00* (2013.01); *D02G 3/32* (2013.01); *D03D 13/004* (2013.01); *D04B 1/14* (2013.01); *D04B 1/18* (2013.01); *D04B 1/22* (2013.01); *D04B 21/18* (2013.01); *D10B 2501/02* (2013.01); *D10B 2501/043* (2013.01)

(58) Field of Classification Search

CPC ... D04B 1/10; D04B 1/14; D04B 1/18; D04B 1/22; D04B 1/246; D04B 1/24; D04B 1/12; D04B 21/18; D10B 2501/02; D10B 2501/043; D10B 2403/0331; A43B 23/028

See application file for complete search history.

(56) References Cited

U.S. PATENT DOCUMENTS

| | | | | |
|---|---|---|---|---|
| 9,903,054 | B2 | 2/2018 | Cross et al. | |
| 10,064,448 | B2 | 9/2018 | Langvin et al. | |
| 11,035,060 | B2 | 6/2021 | Hoying et al. | |
| 2008/0011021 | A1* | 1/2008 | Starbuck | A43B 23/0205 66/170 |
| 2012/0129416 | A1* | 5/2012 | Anand | A43B 23/0205 442/306 |
| 2014/0109286 | A1* | 4/2014 | Blakely | A43B 23/0215 2/69 |

(Continued)

FOREIGN PATENT DOCUMENTS

| | | | |
|---|---|---|---|
| CN | 106793844 | A | 5/2017 |
| DE | 102017223743 | A1 | 6/2019 |

(Continued)

OTHER PUBLICATIONS

Glazzard Martha et al. "Weft-knitted auxetic textile design". Phys. Status Solidi B 251, No. 2, 267-272 (2014) (Year: 2014).*

(Continued)

*Primary Examiner* — Aiying Zhao
(74) *Attorney, Agent, or Firm* — Brooks Kushman P.C.

(57) ABSTRACT

The application relates to a knitted textile for an article of apparel or footwear having (a) a first portion, which is auxetic; (b) a second portion, which is non-auxetic, and wherein the second portion is adjacent to the first portion.

22 Claims, 8 Drawing Sheets

(56) References Cited

U.S. PATENT DOCUMENTS

| | | | | |
|---|---|---|---|---|
| 2016/0058098 | A1* | 3/2016 | Cross | D04B 1/22 24/712 |
| 2016/0058099 | A1* | 3/2016 | Panian | A43B 23/0265 66/170 |
| 2016/0058121 | A1* | 3/2016 | Langvin | A43B 13/14 36/103 |
| 2017/0290376 | A1* | 10/2017 | Maheshwari | D04B 21/207 |
| 2018/0055117 | A1* | 3/2018 | Bailey | A41D 27/28 |
| 2018/0199651 | A1* | 7/2018 | Blakely | A41D 31/04 |
| 2019/0075888 | A1 | 3/2019 | Yip et al. | |
| 2020/0375506 | A1* | 12/2020 | Bishop | B65H 75/28 |

FOREIGN PATENT DOCUMENTS

| | | | | |
|---|---|---|---|---|
| EP | 3430934 | A1 | 1/2019 | |
| EP | 3478110 | B1 | 6/2020 | |
| WO | WO-2019147981 | A1 * | 8/2019 | A43B 1/14 |

OTHER PUBLICATIONS

Office Action for German Application No. 10 2020 208 218.9, dated Apr. 29, 2021, 10 Pages.

Glazzard Martha et al: "Weft-knitted auxetic textile design", Physica Status Solidi B, vol. 251, No. 2, Feb. 1, 2014, pp. 267-272.

Extended European Search Report for EP Application No. 21180735.9, mailed Dec. 9, 2021, 10 Pages.

First Office Action for Chinese Application No. 202110735590.2, dated Dec. 28, 2022, 24 Pages.

Extended European Search Report for EP Application No. 24181282.5, mailed Aug. 12, 2024, 10 Pages.

* cited by examiner

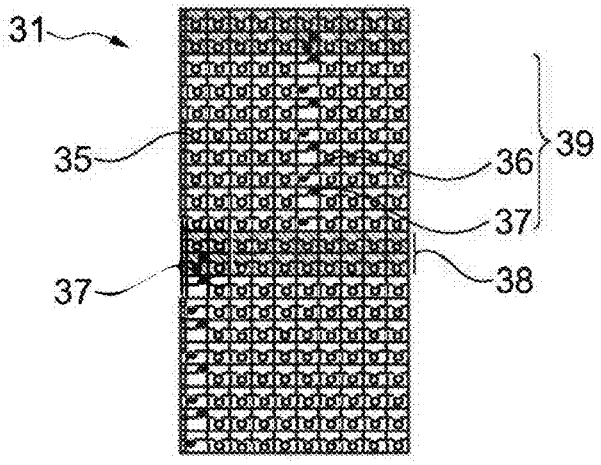
Fig. 5
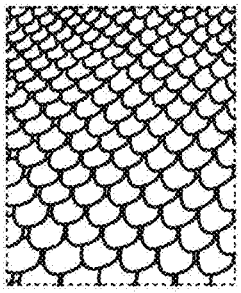
Fig. 6A
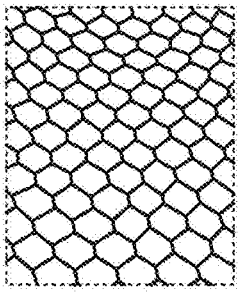
Fig. 6B
Fig. 7A Fig. 7B Fig. 7C
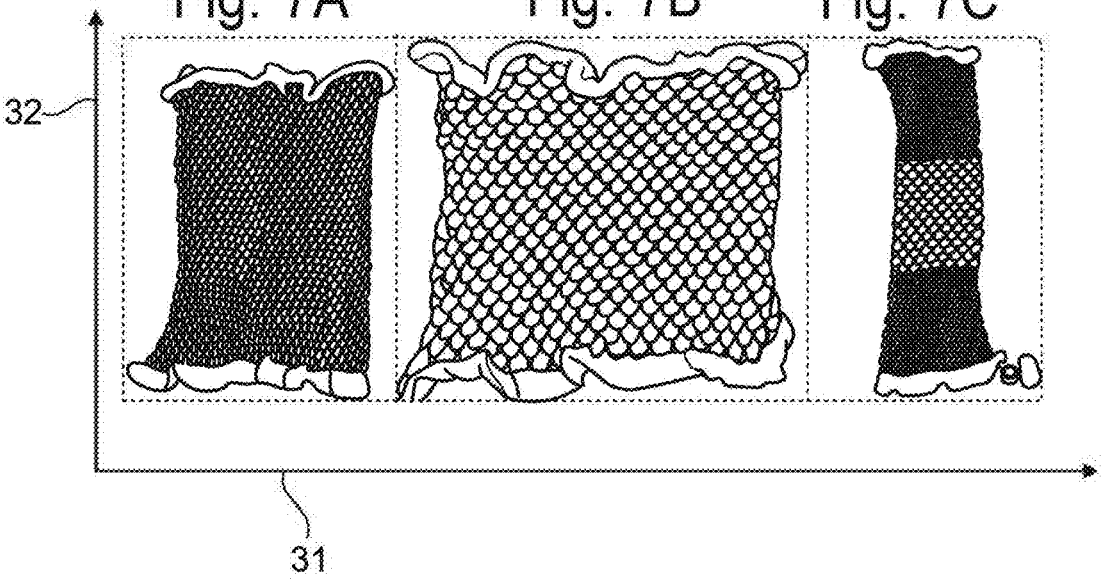

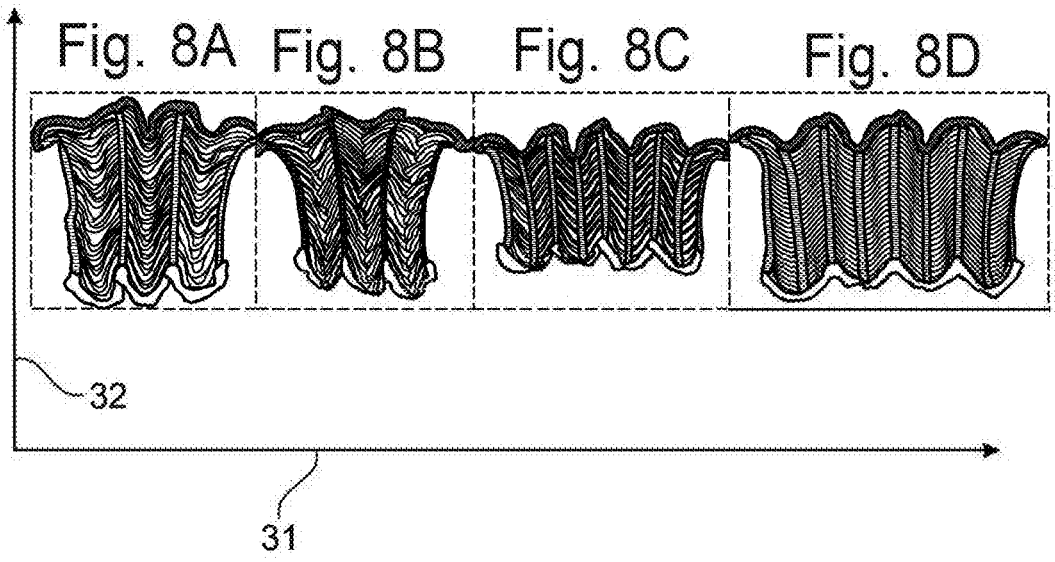
Fig. 8A
Fig. 8B
Fig. 8C
Fig. 8D
32
31
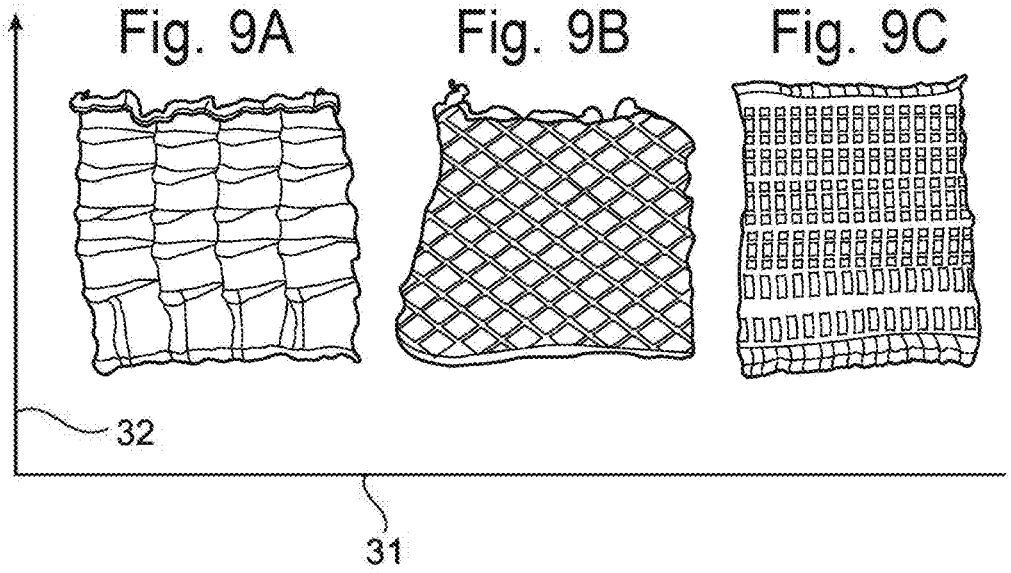
Fig. 9A
Fig. 9B
Fig. 9C
32
31

AUXETIC ARTICLE

CROSS-REFERENCE TO RELATED APPLICATIONS

This application claims foreign priority benefits under 35 U.S.C. § 119(a)-(d) to German patent application number DE 10 2020 208 218.9, filed Jul. 1, 2020, which is incorporated by reference in its entirety.

TECHNICAL FIELD

The present invention relates to a knitted textile for an article of apparel or footwear, and a method for production thereof. The knitted textile comprises a first portion which is auxetic.

PRIOR ART

Knitting is a technique allows a great variety of textiles for apparel or footwear to be produced. Knitted textiles are often preferred due to the high elasticity and the corresponding wearing comfort. However, there remains demand for improvement in particular for athletic applications, where the dynamic properties of the textile are particularly relevant.

For example, during a physical activity the textile may be stretched due to the movement of a wearer's body. In a conventional knitted textile, if the knitted textile is stretched along a first direction, it will contract along a second direction that is essentially perpendicular to the first direction. This may lead to discomfort for a wearer during a physical activity.

It is known that certain materials are auxetic, meaning that if the material is stretched along a first direction, it responds by stretching along a second direction that is essentially perpendicular to the first direction.

US 2018/0199651 A1 relates to an article of apparel that has at least one panel including a first material having a first modulus of elasticity and a second material having a second modulus of elasticity, the first modulus of elasticity being greater than the second modulus of elasticity. An auxetic structure is provided by the first material on the panel and comprises a pattern of reentrant shapes.

US 2017/0290376 A1 relates to a knit or woven bra that may include varying knit or woven structures within zones, varying the modulus of elasticity of the yarns used to form the zones and/or varying the modulus of elasticity of the knit or woven material through a specific knit stitch orientation or a woven technique.

It is an object of the present invention to provide a textile for an article of apparel or footwear that allows the wearing comfort particularly for athletic applications to be improved compared with the prior art. A particular problem underlying the present invention is how to create and control a strong auxetic effect in a knitted textile.

SUMMARY

This object is accomplished by a knitted textile according to claim 1, in particular by a knitted textile for an article of apparel or footwear, comprising: (a) a first portion, which is auxetic; (b) a second portion, which is non-auxetic, and wherein the second portion is adjacent to the first portion.

Thus, the first portion comprises a knit and the second portion comprises a knit. In the context of the present invention, the term auxetic refers to any material with a negative Poisson ratio. Thus, when the first portion is stretched along a first direction, the first portion responds by expanding along a second direction, which is essentially perpendicular to the first direction. Essentially perpendicular means within the typical variations experienced within the knitted textile, for example between 70° and 110°. The second portion is non-auxetic, meaning it has a Poisson ratio equal to or greater than zero.

Due to the auxetic property of the first portion, when the knitted textile is stretched, the damping effect may be experienced by the wearer due to the expansion of the area of the knitted textile that is in contact with the wearer. This simultaneously leads to a reduction in the pressure exerted by the knitted textile onto the wearer and a better distribution of pressure and compression exerted by the knitted textile. Moreover, the air permeability and breathability of the knitted textile is improved in those moments when improved ventilation is most desirable, i.e. when the knitted textile is stretched due to athletic activity. The knitted textile also allows an improved damping and absorption of energy from low frequency and high frequency movements. Overall, the support and wearing comfort is improved over the prior art.

A key insight of the inventors is that in order to control the stretch properties of the knitted textile, it is important to incorporate a second portion, which is non-auxetic.

In the context of the present invention, an article of apparel may be an item of clothing, for example a shirt, a T-shirt, jacket, hat, trousers, shorts, socks, etc. An article of footwear may be a shoe, such as a running shoe, a football boot, a hiking shoe, hiking boot, a tennis shoe, a basketball boot, a golf shoe, a sandal, etc.

The first portion may comprise a first essentially flat element and a first protruding element. This arrangement allows the auxetic properties of the first portion to be created through a geometric auxetic effect and has the advantage of being particularly simple to implement for a large variety of yarns used during knitting. In other words, the auxetic behavior is created by the transformation between the three-dimensional and a flat knitted first portion.

The first portion may further comprise a second essentially flat element and a second protruding element, wherein the flat elements and the protruding elements are arranged in an alternating manner. After extensive development, the inventors have found that such an arrangement allows a particularly pronounced auxetic effect to be created.

The first portion may further comprise a plurality of flat elements and a plurality of protruding elements, wherein a repeating unit of flat elements may comprise at least four adjacent flat elements. In this case, a very strong auxetic effect is observed.

The first portion may further comprise an alternating pattern of face stitches and reverse stitches. Such a pattern may, for example, be created by a series of stitch transfers. Moreover, such a knitting structure may be knitted on a single-bed knitting machine but could be translated to different formats.

The alternating pattern of face stitches and reverse stitches may form a purl rib structure. Such a structure may be auxetic while simultaneously allowing for contraction in different axial planes.

The first portion may be configured to be stretched along a wale direction when worn. The inventors have discovered that the auxetic behavior is often better when the first portion is configured to be stretched along a wale direction when worn. This is particularly true in the case of a purl rib structure.

The first portion may further comprise a ripple pattern. This configuration allows a neat, controlled edge to be added to the first portion.

The first portion may further comprise a reverse ripple pattern. Such an arrangement can be used to create a first portion with different properties on the front and the back which interplay against each other whenever they meet. This allows a three-dimensional property to be impaired onto the fabric, which has been flat out when stretched. Reverse ripple pattern allows the overall length of the first portion to be shortened significantly, compared to patterns that do not use a reverse ripple pattern. Such a configuration is preferably knitted on a two-bed knitting machine. The inventors have found that particular strong auxetic behavior is observed if the reverse ripple pattern is arranged in a rectangular pattern or in a horizontal zigzag pattern.

The first portion may further comprise a tubular Jacquard pattern. A Jacquard pattern may be produced easily and quickly using existing knitting technologies.

This arrangement allows one yarn to be shown on the front of the first portion and another yarn on the back and vice versa. For example, an elastic yarn and an inelastic yarn may be used such as to produce a first portion with different properties on the front and reverse side of the first portion that interact with each other in strategic patterns. This allows a curling inwards and reentrant properties to be created in order to cause an opening to yield an auxetic effect. Such a configuration is preferably knitted on a two-bed knitting machine.

The tubular Jacquard pattern may comprise a triangular pattern. A Jacquard pattern may be produced easily and quickly using existing knitting technologies. This arrangement was discovered to provide a particularly strong auxetic effect.

The first portion may further comprise at least one elastic yarn. The term elastic is to be understood as the skilled person would understand it conventionally. For example, an elastic yarn may comprise elastane. An elastic yarn is advantageous in order to create a strong auxetic effect.

The first portion may further comprise at least one non-elastic yarn, wherein a first knitted row may comprise the elastic yarn and at least five consecutive knitted rows comprise a non-elastic yarn. For example, knitting may comprise knitting stripes of elastic yarn and then tucking non-elastic yarn for up to eight rows. The tucks may be alternated in a brick repeat. The elastic contracts and draws in the first portion. As the first portion is stretched, the contracted sections unfurl causing auxetic behaviour. This configuration may be knitted on a single-bed knitting machine or a two-bed knitting machine.

Any or all of the knitting structures of the first portion disclosed above may be combined and/or shaped in order to produce a knitted textile according to the invention. In particular, it may be possible to create a unitary knitted textile comprising any combination of the knitting structures or configurations of the first portion as disclosed above and any second portion. In the context of the present invention, the term unitary means that the knitted textile may be knitted on a single knitting machine in one production step, i.e. in particular without necessarily cutting and sewing together different pieces.

A further aspect of the invention concerns an article of apparel comprising a knitted textile according to any aspect described herein. The article of apparel thus offers the advantages afforded by the knitted textile.

A further aspect of the invention concerns a bra comprising a knitted textile according to any aspect described herein. The advantageous technical effect of the knitted textile according to the present invention to dampen and absorb energy from movements is particularly advantageous for applications in sports bras. Sports bras are designed to minimize the discomfort felt by women during running by supporting and constraining the breast. A common trade-off in sports bras is active comfort with long term discomfort. The most supporting sports bras are often unsuitable for wearing for extended periods due to severe pressure around the shoulder strap and bust band. By incorporating auxetic knits into the bra construction the performance (e.g., damping and pain reduction) can be improved whilst retaining long term wearing comfort.

The first auxetic portion may be arranged at least in one of: (a) a bust band, (b) a cup region, and (c) a strap region. Thus, it is possible to provide a better fit and wearing comfort to the wearer.

The bra may comprise at least one panel, wherein the panel may comprise the first portion according to any aspect described herein. The sport bra may thus be produced as a garment panel, which is then cut and sewn to create the complete bra. This allows great flexibility in the design of the bra. Alternatively, the sport bra may be produced as a semi-finished panel, where the edges of the panel pieces may have a clean selvedge. The panel pieces are then fused or sewn together to form the complete bra.

A further aspect of the invention concerns an article of footwear comprising a knitted textile according to any aspect described herein. The article of footwear thus offers an improved fit and comfortable dynamic support, especially during athletic activities and movement.

A further aspect of the invention concerns a method of producing a knitted textile for an article of apparel or footwear, comprising: (a) knitting a first portion, which is auxetic; (b) knitting a second portion, which is non-auxetic such that the second portion is adjacent to the first portion.

Such a method may be performed, for example, using a single or double-bed knitting machine, preferably with multi-gauge support. By this method, it is possible to create a knitted textile with the numerous advantages already described herein.

The method may further comprise knitting a first essentially flat element and a first protruding element in the first portion. After extensive development, the inventors have found that such an arrangement allows a particularly pronounced auxetic effect to be created.

The method may further comprise knitting a second essentially flat element and a second protruding element in the first portion, and arranging the flat elements and the protruding elements in an alternating manner. After extensive development, the inventors have found that such an arrangement allows a particularly pronounced auxetic effect to be created.

The method may further comprise knitting a plurality of flat elements and a plurality of protruding elements in the first portion, and arranging at least four adjacent flat elements in a repeating unit of the flat elements. In this case, a very strong auxetic effect is observed.

The method may further comprise knitting an alternating pattern of face stitches and reverse stitches in the first portion. Such a pattern may, for example, be created by a series of stitch transfers. Moreover, such a knitting structure may be knitted on a single-bed knitting machine but could be translated to different formats.

The alternating pattern of face stitches and reverse stitches may form a purl rib structure. Such a structure may be auxetic while simultaneously allowing for contraction in different axial planes.

The method may further comprise configuring the first portion to be stretched along a wale direction when worn. The inventors have discovered that the auxetic behavior is often better when the first portion is configured to be stretched along a wale direction when worn. This is particularly true in the case of a purl rib structure.

The method may further comprise knitting a ripple pattern in the first portion. This configuration allows a neat, controlled edge to be added to the first portion. Such a configuration may, for example, be produced by knitting one knitted row on both needle beds of a two-bed knitting machine, for example using elastic yarn, and then three rows on the front bed only. This creates an extendable fabric, which pulls back into being a tighter, shorter structure than without the ripple pattern.

The method may further comprise knitting a reverse ripple pattern in the first portion. Alternatively, or additionally, the method may further comprise knitting a tubular Jacquard pattern in the first portion. Alternatively, or additionally, the method may further comprise knitting a triangular pattern in the tubular Jacquard pattern.

Advantages and details relating to these aspects are described elsewhere herein with respect to the knitted textile.

The method may further comprise knitting with at least one elastic yarn in the first portion. The term elastic is to be understood as the skilled person would understand it conventionally. For example, an elastic yarn may comprise elastane. An elastic yarn is advantageous in order to create a strong auxetic effect.

The method may further comprise knitting with at least one non-elastic yarn in the first portion, and wherein a first knitted row may comprise the elastic yarn and at least five consecutive knitted rows comprise a non-elastic yarn. Advantages and details relating to these aspects are described elsewhere herein with respect to the knitted textile.

A further aspect of the invention concerns a method of producing an article of apparel comprising producing a knitted textile according to any aspect described herein. The article of apparel thus benefits advantageously as described herein.

A further aspect of the invention concerns a method of producing a bra comprising producing a knitted textile according to any aspect described herein. The bra thus benefits advantageously as described herein.

The method of producing a bra may further comprise arranging the first portion in at least one of: (a) a bust band, (b) a cup region, and (c) a strap region. Thus, it is possible to provide a better fit and wearing comfort to the wearer.

The method of producing a bra may comprise knitting at least one panel by a method according to any aspect described herein. Thus, the bra may be easily tailored to a desired geometry.

A further aspect of the invention concerns a method of producing an article of footwear comprising producing a knitted textile according to any aspect described herein. The article of footwear thus offers an improved fit and comfortable dynamic support, especially during athletic activities and movement.

BRIEF DESCRIPTION OF THE DRAWINGS

The present invention will be described in more detail with reference to the accompanying figures in the following. These figures show:

FIG. 5: an exemplary knitting pattern for a first portion comprising an elastic tuck;

FIGS. 6A-6B: an exemplary first portion comprising an elastic tuck;

FIGS. 7A-7C: an exemplary first portion comprising an elastic tuck;

FIGS. 8A-8D: exemplary first portions comprising ripple pattern;

FIGS. 9A-9C: exemplary first portions comprising a tubular Jacquard pattern;

DETAILED DESCRIPTION

In the following, only some embodiments of the invention are described in detail. It is to be understood that these exemplary embodiments can be modified in a number of ways and combined with each other whenever compatible and that certain features may be omitted in so far as they appear dispensable.

Figure 1A:
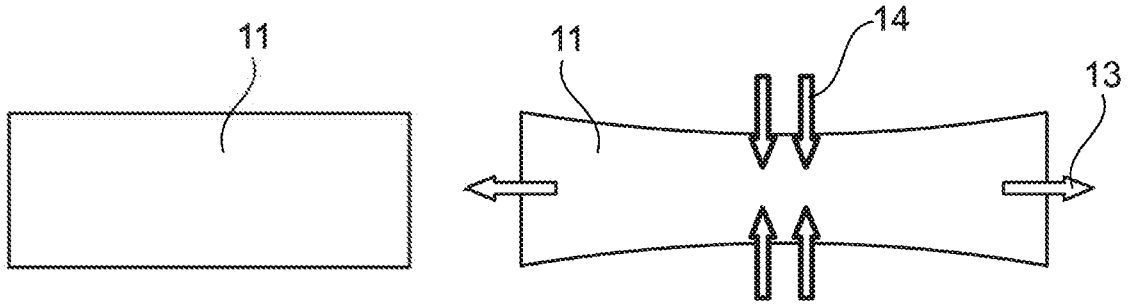
Fig. 1A prior art
FIGS. 1A-1B: an exemplary illustration of a prior art non-auxetic (FIG. 1A) and an auxetic knitted portion (FIG. 1B)
Figure 1B:
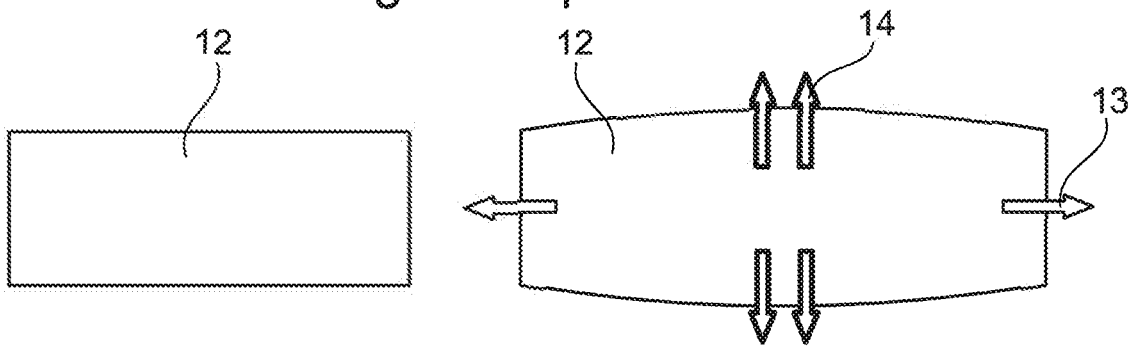
Fig. 1B prior art

FIGS. 1A-1B show an exemplary illustration of a non-auxetic (FIG. 1A) and an auxetic knitted portion (FIG. 1B), which could be used as the first auxetic portion and the second non-auxetic portion in an exemplary knitted textile of the present invention that will be explained below.

FIG. 1A shows an exemplary non-auxetic portion 11 in a relaxed state (left) and a stretched state (right). When the exemplary non-auxetic portion 11 is stretched along a first direction 13, the non-auxetic portion 11 contracts along a second direction 14, which is essentially perpendicular to the first direction 13, as shown in FIG. 1A.

Note that in this example of FIG. 1A, the corresponding Poisson ratio of the non-auxetic portion 11 is greater than zero. However, a non-auxetic portion may also have a Poisson ratio of zero or approximately zero, meaning that when the exemplary non-auxetic portion 11 is stretched along a first direction 13, the non-auxetic portion 11 neither contracts nor expands along a second direction 14, which is essentially perpendicular to the first direction 13.

FIG. 1B shows an exemplary auxetic portion 12 in a relaxed state (left) and a stretched state (right). When the exemplary auxetic portion 12 is stretched along a first direction 13, the auxetic portion 12 expands along a second direction 14, which is essentially perpendicular to the first direction 13, as shown in FIG. 1B.

Figure 2:
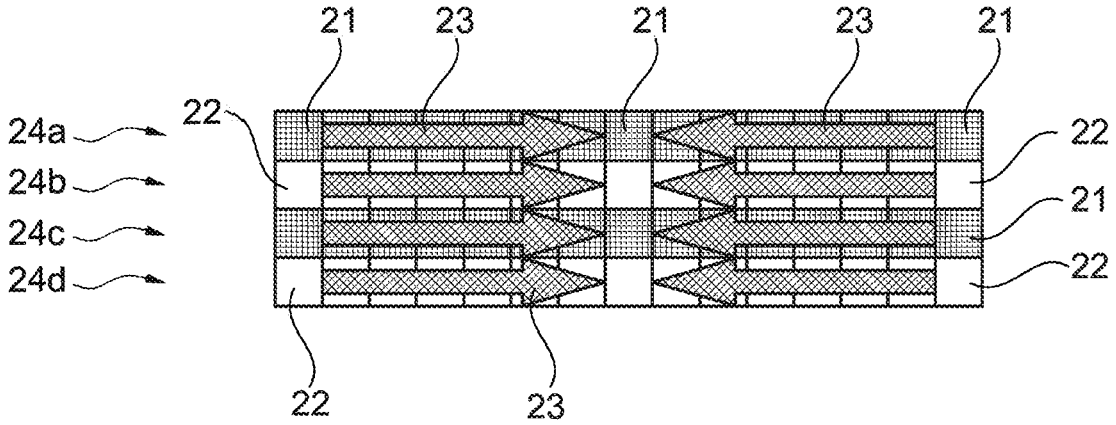
Fig. 2 prior art
FIG. 2: exemplary stitch transfers of a prior art auxetic portion.

FIG. 2 shows exemplary stitch transfers of an auxetic portion, which may be employed according to certain aspects of the present invention. The exemplary auxetic portion comprises an alternating pattern of face stitches and reverse stitches.

Rows of face stitches 21 and rows of reverse stitches 22 are knitted. This may be performed on a single or double-bed knitting machine, also known as two-bed knitting machine. In a first course 24*a*, only face side stitches are made, e.g. on a first needle bed. In a subsequent second course 24*b*, only reverse side stitches are made, e.g. on a second needle bed. In a subsequent third course 24*c*, only face side stitches are made, e.g. on the first needle bed. In a subsequent fourth course 24*d*, only reverse side stitches are made, e.g. on a second needle bed. The direction of the transfer is indicated with reference sign 23.

Figures 3A, 3B, 3C:
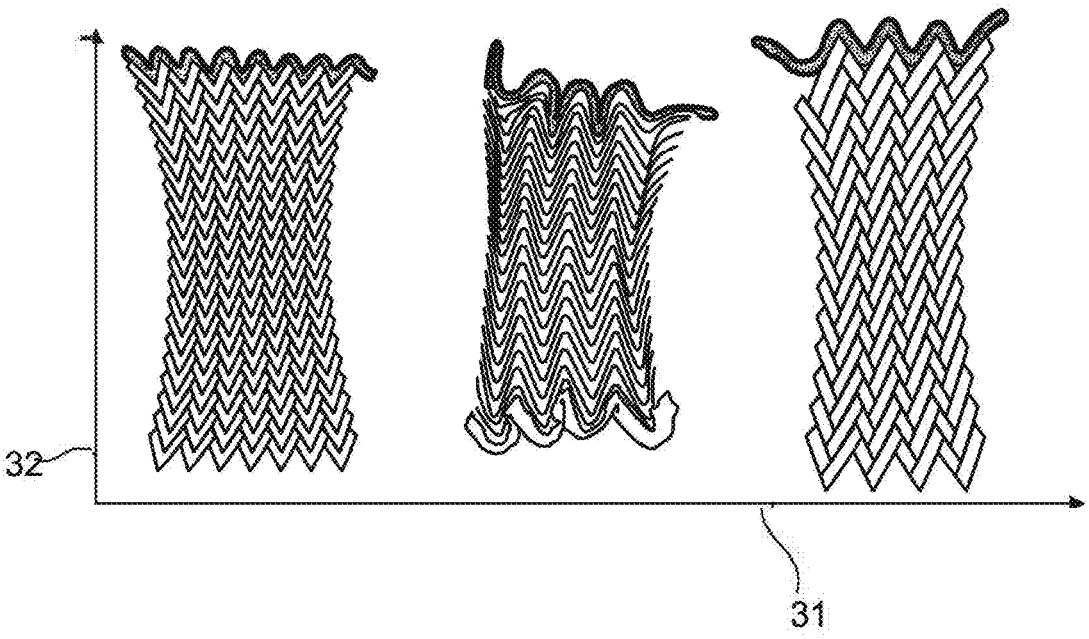
FIGS. 3A-3C: exemplary first portions comprising purl rib structure.

FIGS. 3A-3C show exemplary first auxetic portions of the present invention, which comprises purl rib structure. The horizontal direction 31 is approximately along a course direction of the portion while the vertical direction 32 is approximately along a wale direction.

FIG. 3A shows an exemplary first auxetic portion of a knitted textile comprising a transfer purl rib structure with a transfer section of 12N x 6R, i.e. 12 needles in every 6 rows. Such a structure shows good auxetic behavior.

FIG. 3B shows an exemplary first auxetic portion of a knitted textile comprising a transfer purl rib structure with a wider transfer section of 24N x 6R, i.e. 24 needles in every 6 rows. Such a structure shows very good auxetic behavior.

FIG. 3C shows an exemplary first auxetic portion of a knitted textile comprising a transfer purl rib structure with a deeper scale, compared to FIG. 3B, transfer section of 24N x 12R, i.e. 24 needles in every 12 rows. Such a structure shows very good auxetic behavior.

Figures 4A, 4B:
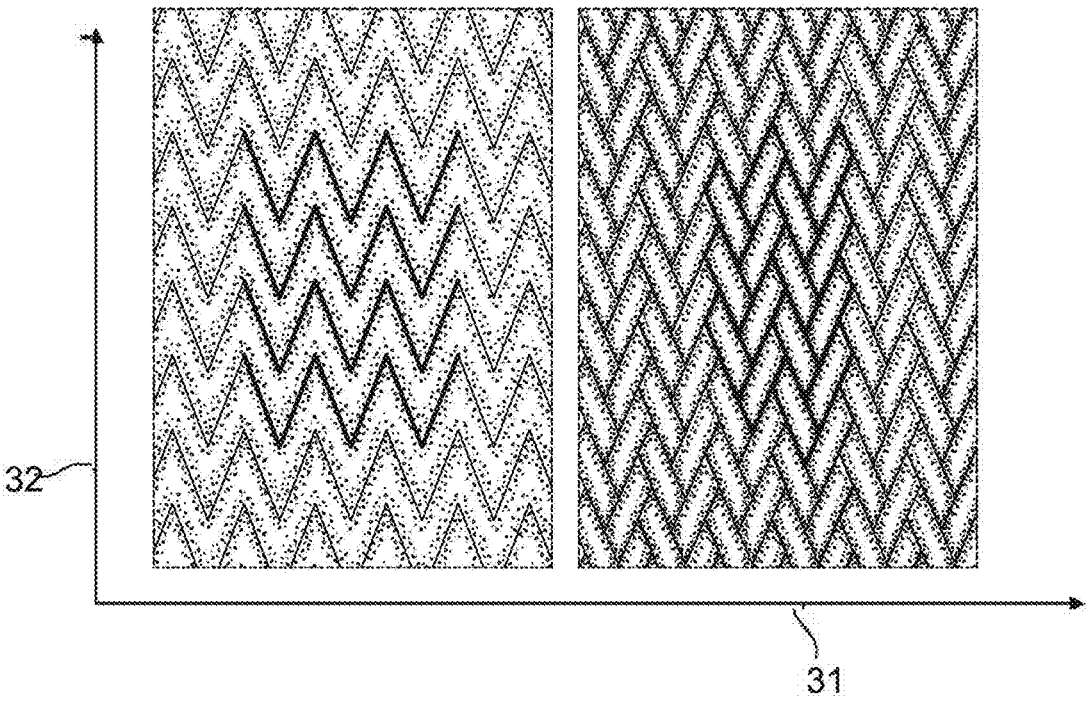
FIGS. 4A-4B: exemplary first portions comprising purl rib structure of continuous (FIG. 4A) or alternating character (FIG. 4B)

FIGS. 4A-4B show exemplary first portions comprising purl rib structure of continuous (FIG. 4A) or alternating character (FIG. 4B). The horizontal direction 31 is approximately along a course direction while the vertical direction 32 is approximately along a wale direction.

FIG. 4A shows an exemplary first portion comprising purl rib structure of continuous character, while FIG. 4B shows an exemplary first portion comprising purl rib structure of alternating character. These structures show good auxetic behavior, especially when stretched along the vertical direction 32.

FIG. 5 shows an exemplary knitting pattern for a first portion comprising an elastic tuck. The tuck stitch is composed of a held loop, one or more tuck loops, and knitted loops.

The knitting pattern is for a first portion that comprises at least one non-elastic yarn, knitted in 8 rows indicated with reference sign 39 and elastic yarn knitted in stripes of two rows as indicated with reference sign 38. The tucks are alternated in a brick repeat. The elastic contracts and draws in the first portion. As the first portion is stretched, the contracted sections unfurl causing auxetic behavior. This configuration may be knitted on a single-bed knitting machine or a two-bed knitting machine. Knitted loops are indicated with reference sign 35 and held loops are indicated with reference signs 36 and 37.

FIG. 6A-6B show an exemplary first knitted portion comprising an elastic tuck. Such an exemplary first portion may result from the knitting pattern shown in FIG. 5. FIG. 6A shows a front view, while FIG. 6B shows a back view of a larger scale of a fabric comprising several repeating units of tuck.

FIGS. 7A-7C show an exemplary first portion comprising an elastic tuck. The horizontal direction 31 is approximately along a course direction while the vertical direction 32 is approximately along a wale direction.

FIG. 7A shows a smaller scale tuck pattern. Auxetic behavior is observed especially when stretched along the vertical direction 32.

FIG. 7B shows a larger scale tuck pattern. Good auxetic behavior is observed especially when stretched along the vertical direction 32.

FIG. 7C shows a variation of tuck scales knitted in a same knitted auxetic portion. Good auxetic behavior is observed especially when stretched along the vertical direction 32.

FIGS. 8A-8D show exemplary first auxetic knitted portions comprising ripple pattern. The horizontal direction 31 is approximately along a course direction while the vertical direction 32 is approximately along a wale direction.

FIG. 8A shows a ripple pattern with 24N by 10R ripples between each pair of transfer sections. Good auxetic behavior is observed when stretched along the vertical direction 32.

FIG. 8B shows another ripple pattern with 24N by 10R ripples between each pair of transfer sections. Good auxetic behavior is observed when stretched along the vertical direction 32.

FIG. 8C shows another ripple pattern with 24N by 10R ripples between each pair of transfer sections. Good auxetic behavior is observed when stretched along the vertical direction 32.

FIG. 8D shows another ripple pattern with 24N by 6R ripples between each pair of transfer sections. Good auxetic behavior is observed when stretched along the vertical direction 32.

Since a good auxetic effect is observed when the first portion is stretched along the vertical direction 32, which is approximately along a wale direction, the first portion is configured to be stretched along a wale direction when worn.

FIGS. 9A-9C show exemplary first auxetic knitted portions comprising a tubular Jacquard pattern. The horizontal direction 31 is approximately along a course direction while the vertical direction 32 is approximately along a wale direction.

FIG. 9A shows a tubular Jacquard pattern with a chiral scroll pattern. Auxetic behavior is observed when stretched along the vertical direction 32.

FIG. 9B shows a tubular Jacquard pattern with a star scroll pattern. Auxetic behavior is observed when stretched along the vertical direction 32.

FIG. 9C shows a tubular Jacquard pattern with a varied triangle pattern. Good auxetic behavior is observed when stretched along the vertical direction 32.

Figure 10:
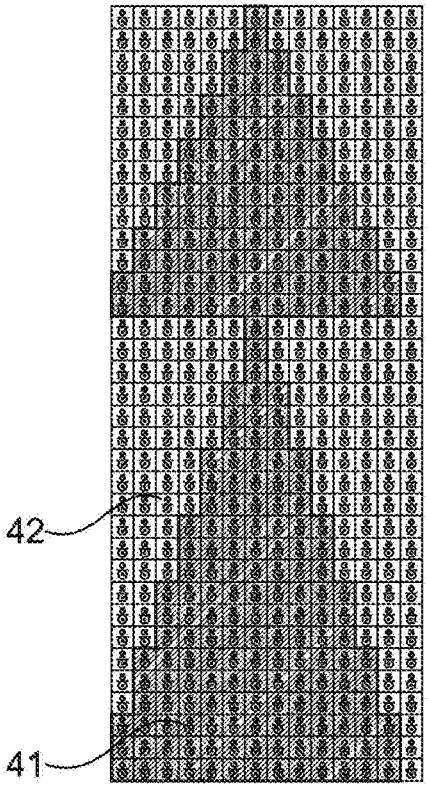
FIG. 10: exemplary knitting pattern for a first portions comprising triangular pattern in a tubular Jacquard pattern.

FIG. 10 shows exemplary knitting pattern for a first portion comprising triangular pattern in a tubular Jacquard pattern. Elastic yarn 41 is knitted into a triangular geometry, while inelastic yarn 42 is used to fill up the remaining space of the tubular Jacquard knit. For example, the inelastic yarn may comprise recycled PET (polyethylene terephthalate) and the elastic yarn may comprise elastane. Good auxetic behavior is observed.

Figure 11A:
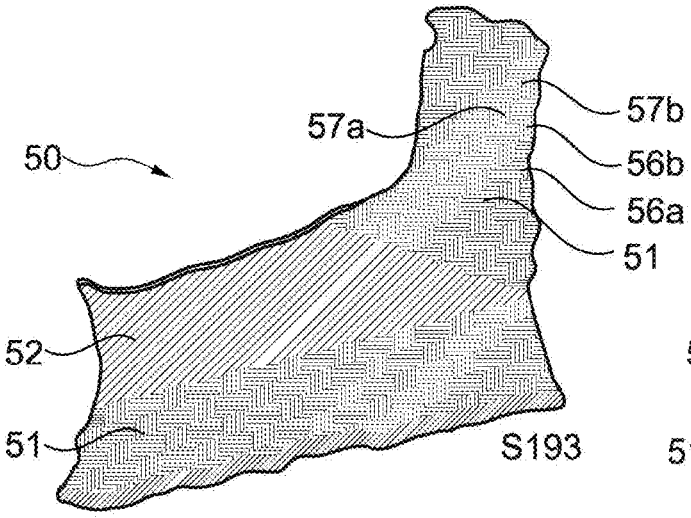
FIGS. 11A-11B: exemplary shaped knitted textiles according to an aspect of the present invention.
Figure 11B:
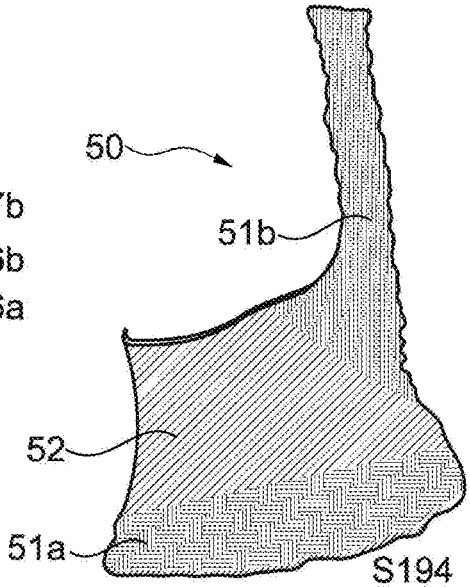

FIGS. 11A-11B show exemplary shaped knitted textiles according to an aspect of the present invention.

FIG. 11A shows a knitted textile 50 for an article of apparel or footwear, comprising: (a) a first portion 51, which is auxetic; (b) a second portion 52, which is non-auxetic, and wherein the second portion 52 is adjacent to the first portion 51.

The first portion 51 comprises a first essentially flat element 56*a* and a first protruding element 57*a*. The first portion further comprises a second essentially flat element

56*b* and a second protruding element 57*b*, wherein the essentially flat elements 56*a*, 56*b* and the protruding elements 57*a*, 57*b* are arranged in an alternating manner.

In this case, the first portion 51 comprises a plurality of essentially flat elements 56*a*, 56*b* and a plurality of protruding elements 57*a*, 57*b*, wherein a repeating unit of flat elements comprise at least four adjacent flat elements.

The first portion 51 comprises reverse ripple pattern while the second portion 52 comprises a single jersey knit. In particular, the knitted textile 50 is an unitary knitted textile which is produced on a single knitting machine in one production step, i.e. in particular without necessarily cutting and sewing together different pieces.

FIG. 11B shows a knitted textile 50 for an article of apparel or footwear, comprising: (a) a first portion 51*a*, 51*b*, which is auxetic; (b) a second portion 52, which is non-auxetic, and wherein the second portion 52 is adjacent to the first portion 51*a*, 51*b*.

One first portion 51*a* comprises reverse ripple pattern while the other first portion 51*b* comprises a tubular Jacquard pattern. The second portion 52 comprises a single jersey knit.

Figure 12A:
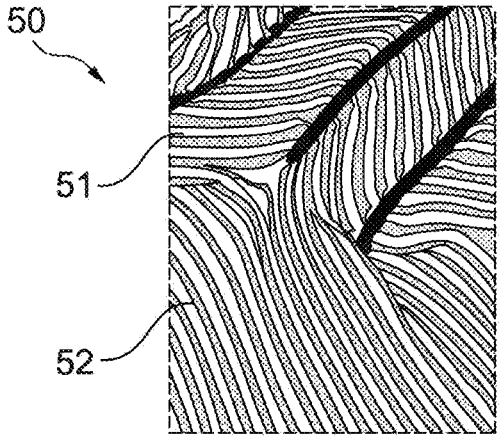
FIGS. 12A-12C: exemplary knitted textiles comprising combinations of different structures according to an aspect of the present invention.
Figure 12B:
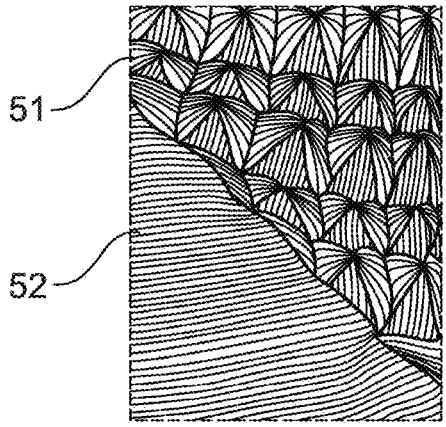
Figure 12C:
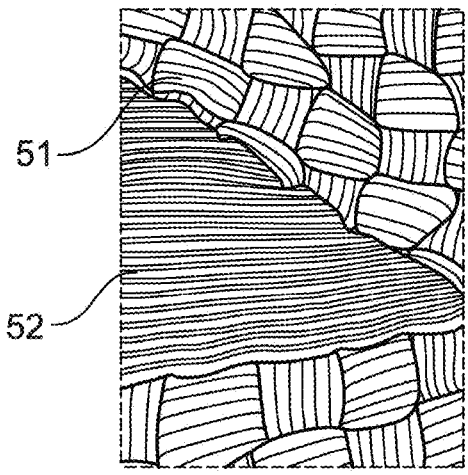

FIGS. 12A-12C show exemplary knitted textiles comprising combinations of different structures according to an aspect of the present invention. The knitted textiles 50 are for an article of apparel or footwear and comprise: (a) a first portion 51, which is auxetic; (b) a second portion 52, which is non-auxetic, and wherein the second portion 52 is adjacent to the first portion 51.

FIG. 12A: The first portion 51 comprises a ripple pattern while the second portion 52 comprises a single-jersey knit.

FIG. 12B: The first portion 51 comprises a tubular Jacquard pattern while the second portion 52 comprises a single-jersey knit.

FIG. 12C: The first portion 51 comprises a reverse ripple pattern while the second portion 52 comprises a single-jersey knit.

FIGS. 13A-13F show exemplary articles of apparel, in this case all examples relate to a sports bra 60, with various arrangements of the first and second portions according to aspects of the present invention.

All sports bras 60 shown in FIGS. 13A-13F comprise a knitted textile for an article of apparel or footwear, comprising: (a) a first portion, which is auxetic; (b) a second portion, which is non-auxetic, and wherein the second portion is adjacent to the first portion.

Figure 13A:
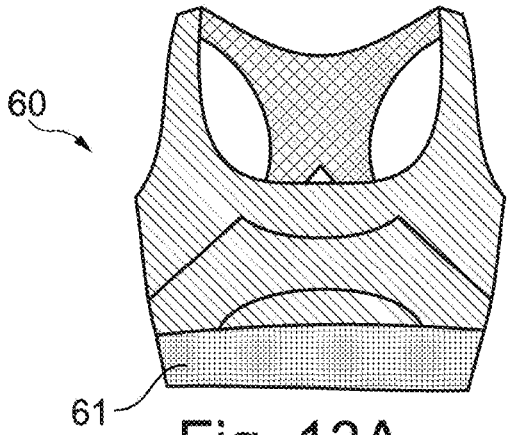
FIGS. 13A-13F: exemplary sports bras showing various arrangements of the first and second portions according to aspects of the present invention.

FIG. 13A shows a sports bra 60 comprising a bust band 61. In this example, the bust band 61 comprises a knitted textile comprising: (a) a first portion, which is auxetic; (b) a second portion, which is non-auxetic, and wherein the second portion is adjacent to the first portion. The bust band 61 may be integrated into the bra 60 using cut-and-sew or may be knit as a whole garment. The bust band 61 is a region of high stretch and high compression.

Figure 13B:
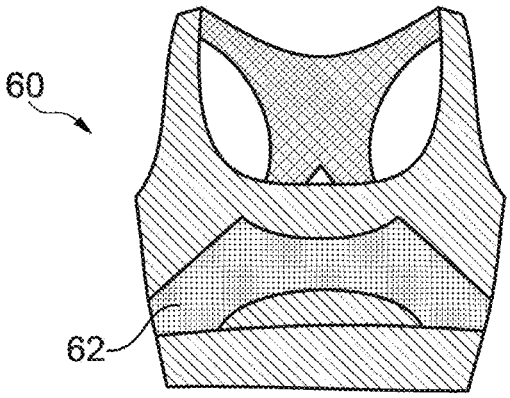

FIG. 13B shows a sports bra 60 comprising a cup support 62. In this example, the cup support 62 comprises a knitted textile comprising: (a) a first portion, which is auxetic; (b) a second portion, which is non-auxetic, and wherein the second portion is adjacent to the first portion.

The bra 60 comprises at least one panel, wherein the panel comprises the first portion. In this case, the panel also comprises the second portion. Thus, the panel comprises the whole knitted textile. Thus, the cup support 62 may be integrated into the bra 60 using cut-and-sew. Alternatively, the bra could be knitted as a unitary garment.

Figure 13C:
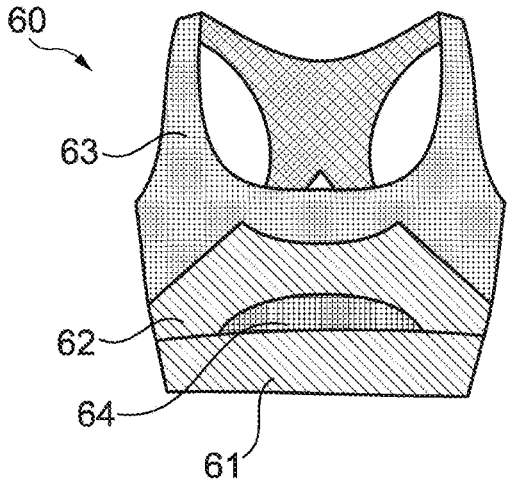

FIG. 13C shows a sports bra 60 comprising a strap region 63 and a front region 64. In this example, the strap region 63 comprises a knitted textile comprising: (a) a first portion, which is auxetic; (b) a second portion, which is non-auxetic, and wherein the second portion is adjacent to the first portion. In this example, the front region 64 comprises a knitted textile comprising: (a) a first portion, which is auxetic; (b) a second portion, which is non-auxetic, and wherein the second portion is adjacent to the first portion. Non-auxetic regions are provided in the cup 62 and bust 61 regions.

Figure 13D:
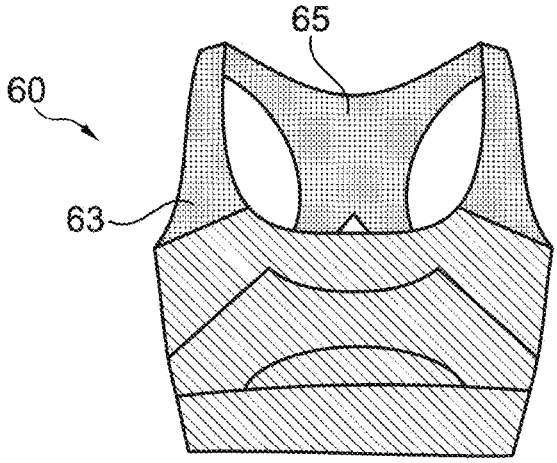

FIG. 13D shows a sports bra 60 comprising a strap region 63 and a back region 65. In this example, the strap region 63 comprises a knitted textile comprising: (a) a first portion, which is auxetic; (b) a second portion, which is non-auxetic, and wherein the second portion is adjacent to the first portion. In this example, the back region 65 comprises a knitted textile comprising: (a) a first portion, which is auxetic; (b) a second portion, which is non-auxetic, and wherein the second portion is adjacent to the first portion. This could be produced as a discrete panel and formed into a bra using cut-and-sew. Alternatively, it could be produced as a whole garment.

Figure 13E:
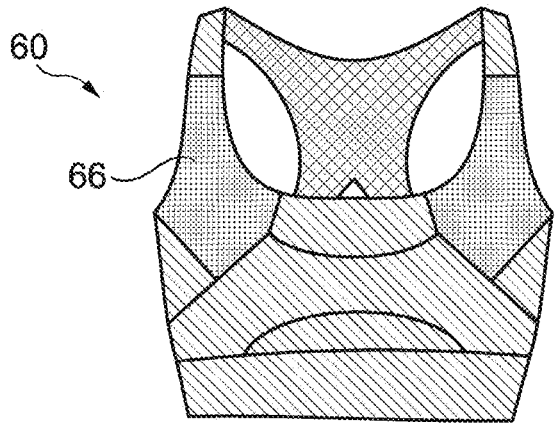

FIG. 13E shows a sports bra 60 comprising a lower strap region 66. In this example, the lower strap region 66 comprises a knitted textile comprising: (a) a first portion, which is auxetic; (b) a second portion, which is non-auxetic, and wherein the second portion is adjacent to the first portion.

Figure 13F:
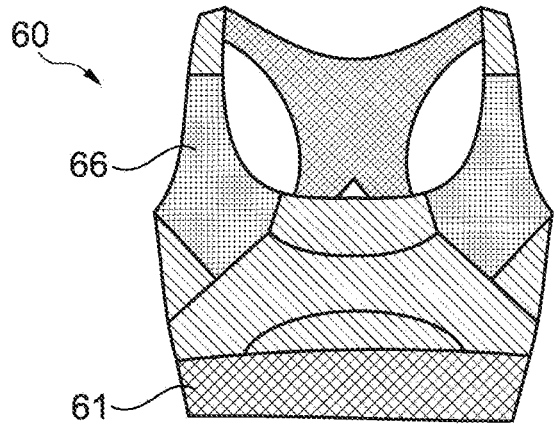

FIG. 13F illustrates how various geometrical arrangements may be combined with one another in order to ideally tailor the bra for a particular application or to allow for personal preferences. For example, FIG. 13F shows a sports bra 60 comprising a lower strap region 66 and a bust region 61.

In this example, the lower strap region 66 comprises a first knitted textile comprising: (a) a first portion, which is auxetic; (b) a second portion, which is non-auxetic, and wherein the second portion is adjacent to the first portion.

In this example, the bust band 61 comprises a second knitted textile comprising: (a) a third portion, which is auxetic; (b) a fourth portion, which is non-auxetic, and wherein the third portion is adjacent to the fourth portion.

The third portion may be similar to the first portion in terms of the knitting structure used, e.g. both structures may comprise a ripple pattern, but it is also possible that the third portion is different to the first portion in terms of the knitting structure. For example, the first portion may comprise a ripple pattern while the second portion may comprise a tubular Jacquard pattern. Similarly, the second and fourth portions may be similar in terms of the knitting structure or may be different.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

REFERENCE SIGNS

11: non-auxetic portion
12: auxetic portion
21: rows of face stitches

22 rows of reverse stitches
23: direction of transfer
24*a-d*: first-fourth course
31 horizontal direction
32: vertical direction
36: held loop
37: knitted loop
41: elastic yarn
42: inelastic yarn
50 knitted textile
51: first portion
52: second portion
56: essentially flat element
57: protruding element
60: sports bra
61: bust band
62: cup support
63 strap region
64: front region
65: back region
66: lower strap region

What is claimed is:

1. A knitted textile for an article of apparel or footwear, comprising:

a first portion which is auxetic and has a first knit pattern of stitches formed in a first plurality of rows, the first portion defining a first textile area, wherein the first portion being auxetic is configured to stretch in a first direction and expand along a second direction essentially perpendicular to the first direction; and a second portion which is non-auxetic and has a second knit pattern of stitches formed in a second plurality of rows, the second portion defining a second textile area, the second knit pattern of stitches being different than the first knit pattern of stitches, wherein the second textile area is positioned adjacent the first textile area and is knitted to the first textile area to control stretch properties of the knitted textile.

2. The knitted textile according to claim 1, wherein the first knit pattern comprises a first essentially flat element and a first protruding element.

3. The knitted textile according to claim 2, wherein the first knit pattern further comprises a second essentially flat element and a second protruding element, wherein one of the first and second essentially flat elements alternates with one of the first and second protruding elements.

4. The knitted textile according to claim 1, wherein the first knit pattern of stitches comprises a plurality of essentially flat elements and a plurality of protruding elements, wherein a repeating unit of the plurality of essentially flat elements comprises at least four essentially flat elements of the plurality of essentially flat elements arranged adjacent each other, wherein the repeating unit of the plurality of essentially flat elements is arranged to alternate with at least one of the protruding elements of the plurality of protruding elements.

5. The knitted textile according to claim 1, wherein the first knit pattern of stitches comprises an alternating pattern of face stitches and reverse stitches.

6. The knitted textile according to claim 5, wherein the alternating pattern of face stitches and reverse stitches forms a purl rib structure.

7. The knitted textile according to claim 1, wherein the first direction comprises a wale direction and wherein the first knit pattern of stitches of the first plurality of rows extending in the wale direction and is configured to be stretched along the wale direction when worn, wherein the second portion has a Poisson's ratio of approximately zero.

8. The knitted textile according to claim 1, wherein the first knit pattern of stitches comprises at least one of a ripple pattern, a reverse ripple pattern, or a tubular Jacquard pattern.

9. The knitted textile according to claim 1, wherein the first textile area further comprises at least one elastic yarn.

10. The knitted textile according to claim 9, wherein the first textile area further comprises at least one non-elastic yarn, wherein the first plurality of rows comprises a first knitted row with the at least one elastic yarn and at least five consecutive knitted rows with the at least one non-elastic yarn.

11. An article of apparel formed of a knitted textile according to claim 1.

12. The article of apparel according to claim 11 comprises a bra comprising the knitted textile being at least one of a bust band, a cup region or a strap region.

13. An article of footwear having a knitted textile according to claim 1.

14. A knitted textile for an article of apparel or footwear, comprising:

a first portion being auxetic with a first knit pattern of stitches formed in a plurality of rows, the plurality of rows extending in a wale direction, the first knit pattern of stitches defining at least one protruding element and at least one flat element; and a second portion being non-auxetic with a second knit pattern of stitches different from the first knit pattern of stitches, and wherein the second portion is positioned adjacent to the first portion and knitted to the first portion, wherein the first portion is configured to be stretched along the wale direction to control stretch properties of the knitted textile.

15. The knitted textile according to claim 14, wherein the first knit pattern of stitches comprises an alternating pattern comprising face stitches and reverse stitches.

16. The knitted textile according to claim 15, wherein the alternating pattern comprises a purl rib structure.

17. The knitted textile according to claim 14, wherein the first knit pattern of stitches comprises an alternating pattern comprising essentially flat stitches and protruding stitches protruding from the essentially flat stitches.

18. The knitted textile according to claim 17, wherein the first knit pattern comprises at least one of a ripple pattern, a reverse ripple pattern, or a tubular Jacquard pattern.

19. The knitted textile according to claim 1, further comprising:

a third portion formed in a third plurality of rows, the third portion defining a third textile area, wherein the third portion is auxetic and has a third knit pattern of stitches being different than the second knit pattern of stitches.

20. A knitted textile comprising:

a first auxetic portion having a first knit pattern of stitches formed of a plurality of rows, the first auxetic portion extending in a wale direction; and a second non-auxetic portion having a second knit pattern of stitches different from the first knit pattern of stitches, and wherein the first auxetic portion is configured to be stretched along the wale direction and expand along a second direction essentially perpendicular to the wale direction, wherein the second non-auxetic portion is positioned adjacent to and is joined to the first portion to control stretch properties of the knitted textile.

21. The knitted textile according to claim 20, wherein the first auxetic portion is knitted to the second non-auxetic portion along an outer edge of the second non-auxetic portion.

22. The knitted textile according to claim 20, wherein the first knit pattern comprises an alternating pattern of face stitches and reverse stitches.

* * * * *